US005813624A

United States Patent [19]

Grasso et al.

[11] Patent Number: 5,813,624

[45] Date of Patent: Sep. 29, 1998

[54] APPARATUS FOR DISPENSING TOILET TISSUE FROM ROLLS

[75] Inventors: Kamala J. Grasso, Wayland; Jason E. Short, Cambridge, both of Mass.; Robert Mervar, Hillsboro, Oreg.; John R. Moody, Antioch, Calif.; Douglas W. Johnson, Appleton, Wis.; Peter D. Johnson, Newtown, Conn.

[73] Assignee: Fort James Corporation, Richmond, Va.

[21] Appl. No.: 728,208

[22] Filed: Oct. 10, 1996

[51] Int. Cl.[6] ..... B65H 67/02

[52] U.S. Cl. ..... 242/560; 242/597.8

[58] Field of Search ..... 242/560, 597.5, 242/597.8, 597.6; 312/34.8, 34.19, 34.21, 34.23

[56] References Cited

U.S. PATENT DOCUMENTS

| | | | |
|---|---|---|---|
| 1,885,192 | 11/1932 | Elssner et al. | 242/597.6 X |
| 2,487,763 | 11/1949 | Patterson et al. . | |
| 3,010,670 | 11/1961 | Jones et al. . | |
| 3,184,176 | 5/1965 | Tucker et al. | 242/560 |
| 3,211,504 | 10/1965 | Bump | 242/560 |
| 3,294,329 | 12/1966 | Tucker | 242/597.8 X |
| 3,381,909 | 5/1968 | Tucker et al. . | |
| 3,418,029 | 12/1968 | Wooster | 242/597.8 X |
| 3,420,465 | 1/1969 | Brunner et al. | 242/597.6 X |
| 3,637,276 | 1/1972 | Bump | 242/560 |
| 3,656,699 | 4/1972 | Schnyder et al. | 242/597.8 X |
| 4,375,874 | 3/1983 | Leotta et al. . | |
| 4,998,681 | 3/1991 | NcNeill . | |
| 5,265,816 | 11/1993 | Collins . | |
| 5,323,980 | 6/1994 | Neveu et al. | 242/597.6 |

*Primary Examiner*—Daniel P. Stodola
*Assistant Examiner*—Gregory J. Strimbu

[57] ABSTRACT

Apparatus for dispensing toilet tissue alternately from two rolls includes a housing and roll support spindles for supporting the rolls in coaxial spaced relationship relative to the housing. A sliding cover is slidably positioned on the housing. The roll support spindles are mounted on a pivoted support frame and a pivoted plate depends from the support frame and is located in the space between adjacent roll ends. The cover includes detents which cooperate with the pivoted plate to allow sliding of the cover on the housing to expose a different roll of toilet tissue only when one of the rolls is substantially depleted.

7 Claims, 7 Drawing Sheets

APPARATUS FOR DISPENSING TOILET TISSUE FROM ROLLS

TECHNICAL FIELD

This invention relates to dispenser apparatus for dispensing toilet tissue from two rolls thereof on an alternate basis.

BACKGROUND OF THE INVENTION

It is known in the prior art to employ dispensers holding two or more rolls of toilet tissue or similar sheet material which maintain at least one of the rolls as a reserve roll while the sheet material is being dispensed from the other roll. Such devices are usually, but not exclusively, employed in institutional environments such as public rest rooms.

A search of the prior art located the following United States patents which are believed to be representative of the current state of the prior art in this field: U.S. Pat. Nos. 3,010,670, issued Nov. 28, 1961, 5,265,816, issued Nov. 30, 1993, 3,656,699, issued Apr. 18, 1972, 3,211,504, issued Oct. 12, 1965, 3,294,329, issued Dec. 27, 1966, 4,998,681, issued Mar. 12, 1991, 4,375,874, issued Mar. 8, 1983, 3,637,276, issued Jan. 25, 1972, 3,381,909, issued May 7, 1968, and 2,487,763, issued Nov. 8, 1949.

The present invention is characterized by its relative simplicity, reliability, and low manufacturing cost as compared to conventional prior art arrangements which, for example, can employ relatively complicated structures, including springs, to control access to two or more rolls from which sheet material is to be dispensed. Furthermore, many prior art dispenser arrangements cannot be utilized to dispense from rolls without cores, i.e. coreless rolls. The apparatus disclosed and claimed herein, on the other hand, is suitable for such purpose. The subject invention also incorporates structure which facilitates roll replenishment, as compared to some prior art dispensing systems which may require considerable time, effort, and experience to accomplish such end.

DISCLOSURE OF INVENTION

The present invention relates to dispenser apparatus, namely for alternately dispensing toilet tissue from two rolls of toilet tissue.

The apparatus includes a double-ended housing defining a housing interior and including a first housing member and a second housing member connected to the first housing member and movable relative to the first housing member between an open position and a closed position.

Roll support means including first and second roll support spindles is provided for supporting first and second rolls of toilet tissue in a coaxial relationship with the first roll of toilet tissue located adjacent to one of the ends of the housing, the second roll of toilet tissue located adjacent to the other of the ends of the housing, and adjacent ends of the rolls of toilet tissue defining a space therebetween.

A moveable cover is positioned on the second housing member and selectively slidably movable relative to the housing between a first cover position wherein the first roll of toilet tissue is exposed for manual access and a second roll of toilet tissue is not exposed for manual access and a second cover location wherein the second roll of toilet tissue is exposed for manual access and a first roll or toilet tissue is not exposed for manual access.

Locking means is provided for locking the cover against slidable movement relative to the second housing member between the first and second cover locations until substantial depletion of one of the rolls of toilet tissue. The locking means includes a toilet tissue roll end engagement member pivotally mounted on the roll support means at a location between the first and second roll support spindles, dependent from the roll support means, and positioned in the space defined by adjacent ends of toilet tissue rolls supported by the roll support means. The locking means additionally includes one or more detents on the cover engageable with the toilet tissue roll end engagement member.

More specifically, the detent means comprises two spaced detents on the cover alternately engageable with the toilet tissue roll end engagement member. One of the detents is cooperable with the toilet tissue roll end engagement member to prevent sliding of the cover in the direction of one of the housing ends and the other of the detents is cooperable with the toilet tissue roll end engagement member to prevent sliding of the cover in the direction of the other of the ends of the housing.

The toilet tissue roll end engagement member is freely pivotally mounted on the roll support means and continuously urged by the force of gravity into a substantially vertical orientation in the space defined by adjacent ends of toilet tissue rolls supported by the roll support means when the second housing member is in closed position. A detent, when a force is exerted on the cover to effect sliding movement of the cover relative to the housing, urges the toilet tissue roll end engagement member to an inclined orientation.

Other features, advantages, and objects of the present invention will become apparent with reference to the following description and accompanying drawings.

MODES FOR CARRYING OUT THE INVENTION

Figure 1:
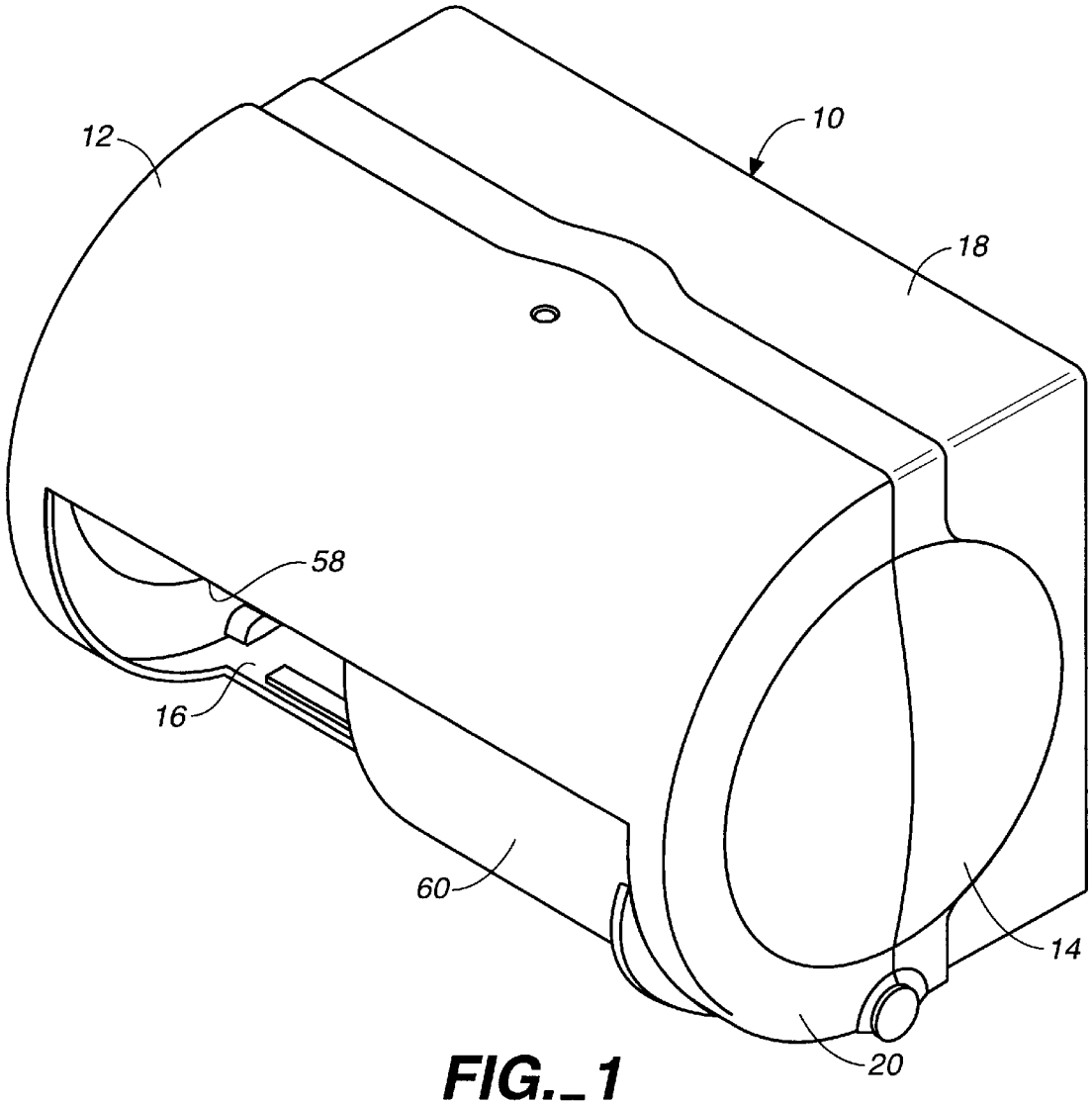
FIG. 1 is a perspective view of apparatus constructed in accordance with the teachings of the present invention with the first and second housing members thereof secured together in dispensing condition.

Referring now to FIGS. 1 through 6A, dispenser apparatus constructed in accordance with the teachings of the present invention includes a housing 10 having ends 12, 14 and defining a housing interior 16. The housing 10 includes a first housing member 18 for attachment to a wall or other support surface and a second housing member 20 which is pivotally connected to the first housing member and movable between the closed position shown in FIG. 1 and the open position shown in FIG. 2. Pivotal movement takes place about a pivot rod 22 to which the housing members are connected and a latch 24 of any suitable type is utilized to latch the housing members closed during dispensing of toilet tissue from the dispenser apparatus. therefrom.

Also pivotally mounted on pivot rod 22 is roll support means including a support frame 30 having axially aligned roll support spindles 32, 34 projecting outwardly from the support frame and away from each other. Support frame 30 defines an opening 36 therein.

Support frame 30 includes a bifurcated projection 38 from which depends a toilet tissue roll end engagement member 40 in the form of a flat plate which is freely pivotally mounted to the projection. Gravity will urge the toilet tissue roll end engagement member or plate 40 to the vertical condition (shown in FIG. 4, for example), if no outside forces are applied thereto. The toilet tissue roll end engagement member 40 is pivotally mounted on the support frame 30 at a location between the roll support spindles 32, 34 with the member or plate 30 positioned in the space defined by adjacent ends of toilet tissue rolls supported by the roll support spindles. A rib 39 projects from second housing member 20 and is received by bifurcated projection 38 when the second housing member 20 is closed to add structural stability.

Figure 2:
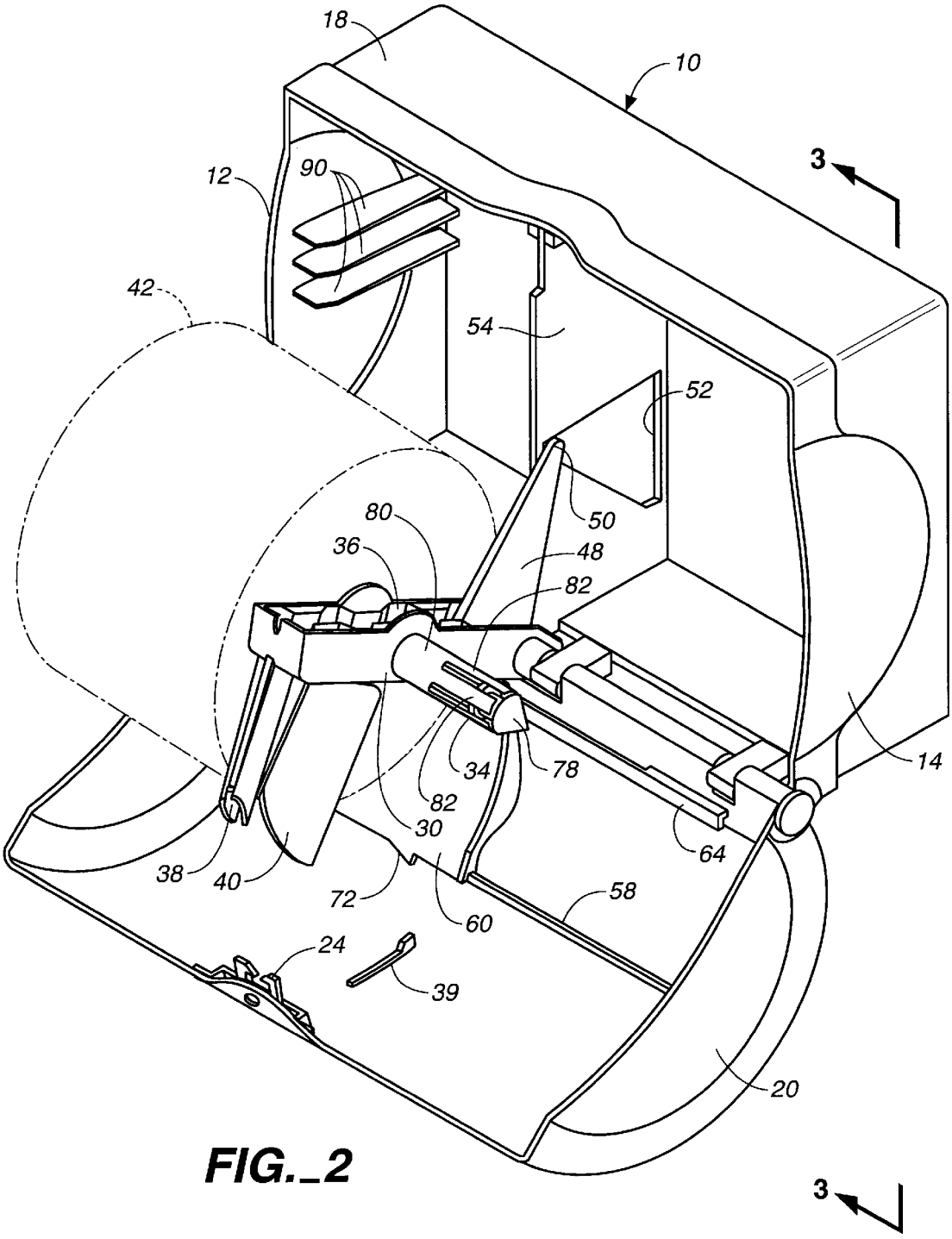
FIG. 2 is a perspective view of the apparatus showing the first and second housing members pivoted apart to disclose the interior mechanism of the apparatus including roll support means and locking means.
Figure 3:
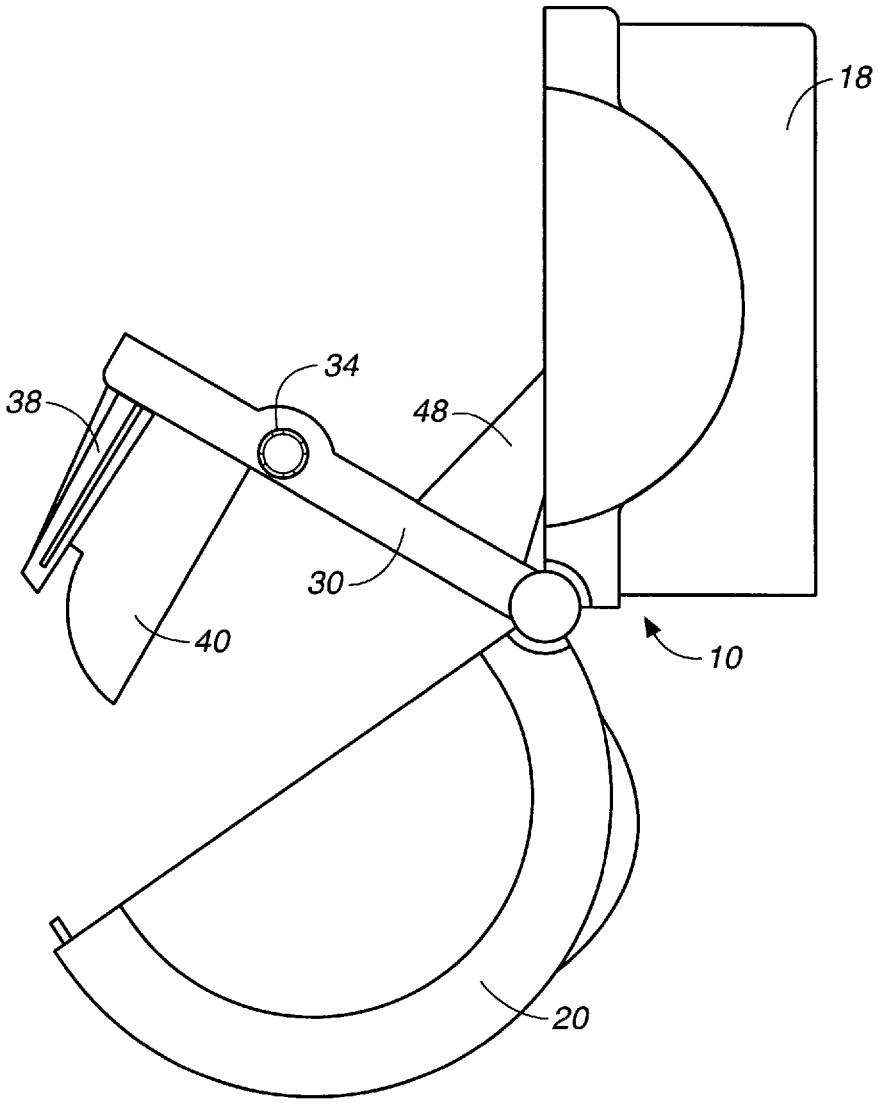
FIG. 3 is a simplified side view taken along the line 3—3 in FIG. 2.
Figure 6A:
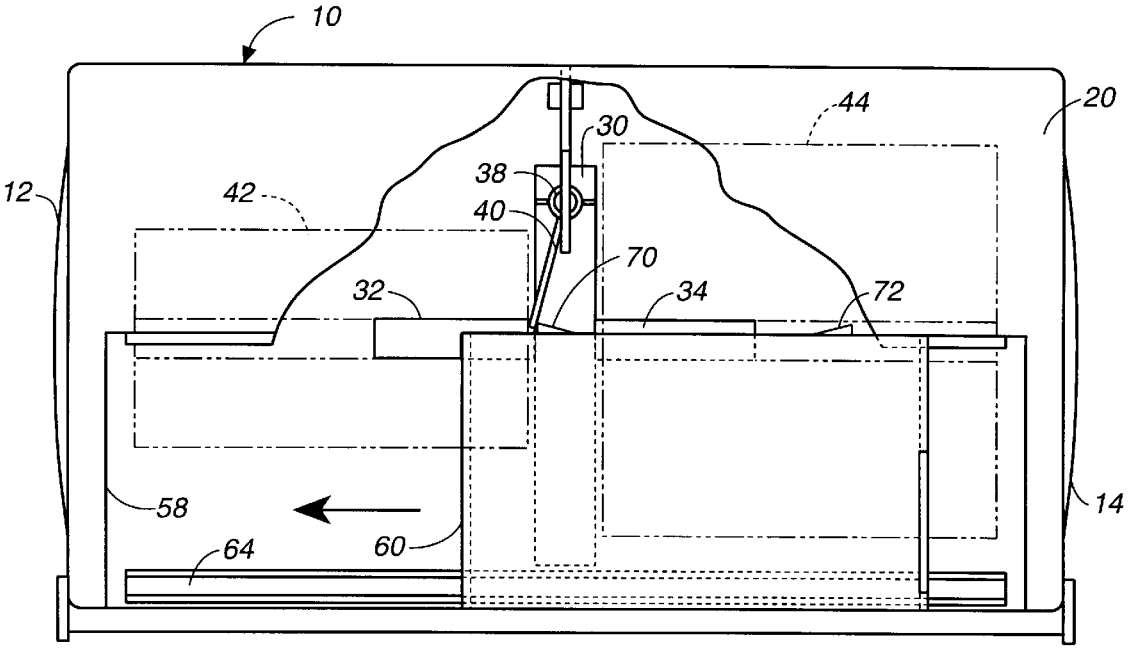
FIGS. 6A and 6B are front elevational views of the apparatus illustrating the respective positions assumed by selected structural elements thereof during different stages of operation of the apparatus.

In FIGS. 2, 6 and 6A, toilet tissue rolls are illustrated in dash lines. Toilet tissue roll 42 is mounted on roll support spindle 32 (FIGS. 2 and 6) and toilet tissue roll 44 is mounted on roll support spindle 34 (FIGS. 6 and 6A).

Figure 5:
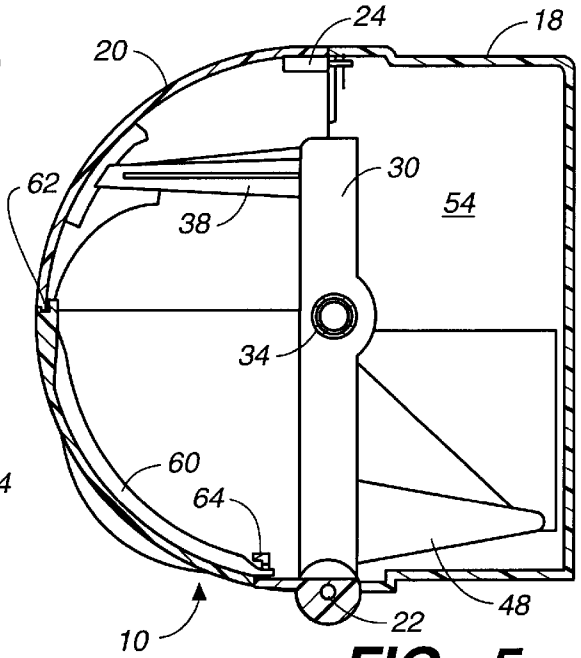
FIG. 5 is a cross-sectional view taken along the line 5—5 of FIG. 4.

The roll support means including support frame 30 and roll support spindles 32, 34 is pivotally movable between the positions shown in FIG. 2 and FIG. 5. That is, pivotal movement of the support frame relative to the first housing member causes the roll support spindles to move either toward or away from the first housing member. Of course, the roll support means is in the position shown in FIG. 5 during dispensing operation of the dispenser and in the position shown in FIG. 2 when the front or second housing member 20 has been pivoted to an open position facilitating replenishment of toilet tissue rolls during servicing of the dispenser apparatus. Pivotal movement of the support frame to limit the distance the roll support spindles may be moved away from the first housing member is limited by an extension 48 of the support frame 30 which has a distal end 50 projecting into the confines of an opening 52 formed in a stabilizer plate 54 projecting outwardly from the back wall of the first housing member.

Opening 36 in support frame 30 receives stabilizer plate 54 when the support frame is in the position shown in FIG. 5 to stabilize not only the support frame but also the roll support spindles and the toilet tissue rolls supported thereby. Preferably opening 36 is so dimensioned or restricted as to provide engagement between the support frame and the stabilizer plate when the support frame has been pivoted upwardly into its dispensing position.

Front or second housing member 20 defines an opening 58 accommodating a cover 60 slidably movable within the opening 58 relative to the second housing member. The cover 60 is movable between a first cover location wherein a first roll of toilet tissue is exposed for manual access and a second roll of toilet tissue is not exposed for manual access and a second cover location wherein the second roll of toilet tissue is exposed for manual access and a first roll of toilet tissue is not exposed for manual access. That is, the cover 60 may be slid relative to the second housing member 20 by a manual force being exerted thereon between the position shown in FIG. 1, for example, and that shown in FIG. 2, for example. At its upper edge cover 60 defines a slot 62 which receives second housing member 20 where the second housing member defines opening 58. At its lower edge cover 60 is received within a slot defined by the second housing member and a longitudinally extending reinforcement member 64.

Locking means is provided for locking the cover against slidable movement relative to the second housing member between the first and second cover locations until substantial depletion of one of the rolls of toilet tissue. The above-described toilet tissue roll end engagement member 40 comprises one element of such locking means. The other constituent element of the locking means are detents on the cover engageable with the tissue roll end engagement member.

More specifically, two spaced detents 70, 72 on the cover are alternately engageable with the toilet tissue roll end engagement member. Detent 70 is cooperable with the toilet tissue roll end engagement member 40 to prevent sliding of the cover in the direction of end 12 of the housing and detent 72 is cooperable with the toilet tissue roll end engagement member to prevent sliding of the cover in the direction of housing end 14. As will now be seen, the detents and toilet tissue roll end engagement member 40 will cooperate to lock the cover against sliding movement only up to the point where a toilet tissue roll is substantially depleted on a spindle toward which the cover is being manually urged.

FIG. 6A shows toilet tissue roll 42 partially depleted and toilet tissue roll 44 comprising a full roll. If a force is exerted on the cover 60 in the direction of the bold arrow shown in FIG. 6A, movement of the cover toward housing end 12 is prevented due to engagement of member 40 with an end of roll 42 and by engagement of detent 70 with the member 40.

It will be noted that the detents are triangular shaped and each includes a substantially straight abutment surface projecting orthogonally relative to the path of sliding movement of the cover and an inclined ramp surface leading from the abutment surface.

Figure 6B:
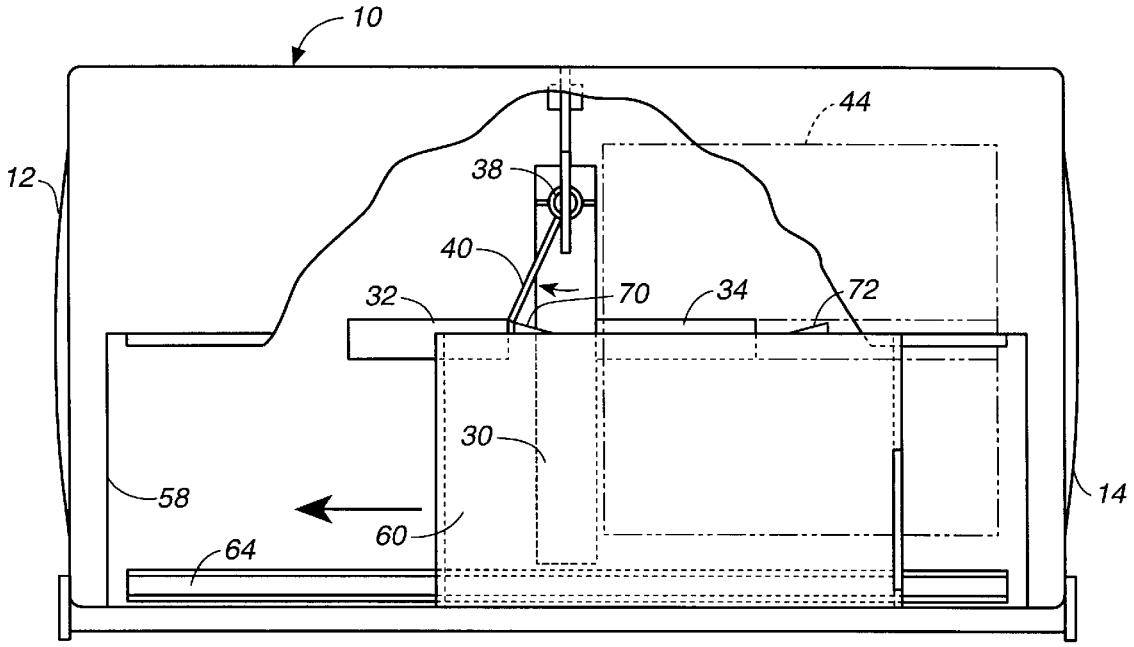

FIG. 6B illustrates the operation of the device after toilet tissue roll 42 has been depleted. Depletion of the toilet tissue roll 42 allows the roll end engagement member 40 to be rotated, as shown by the small bold arrow, about projection 38 sufficiently by detent 70 as a result of force applied by manually sliding cover 60 in direction of the large bold arrow such that detent 70 clears (or passes under) member 40 and cover 60 can be slid completely to end 12 of the housing, thus exposing toilet tissue roll 44 for manual access thereto through opening 58. Of course, the direction of movement of the structural elements just described is reversed when roll 44 is depleted and roll 42 is to be exposed.

Figure 4:
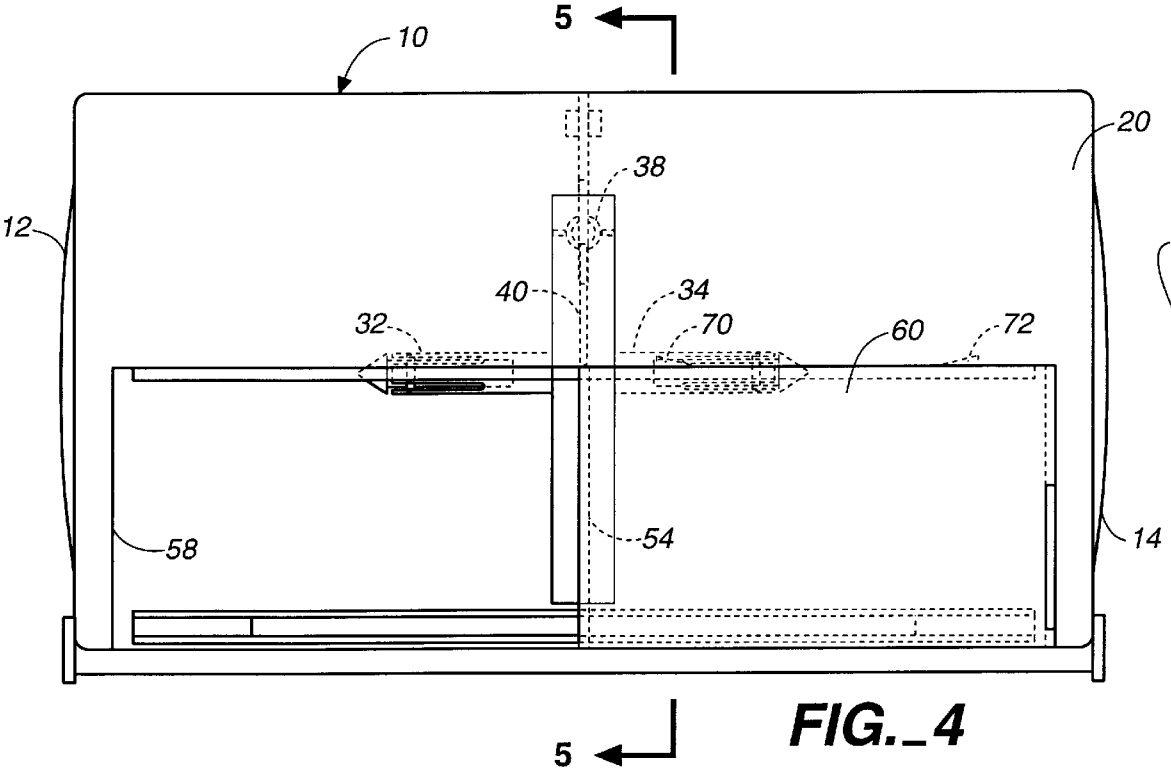
FIG. 4 is a front elevational view of the apparatus with the first and second housing members thereof secured together.

Additional structural and operating features of the dispenser apparatus are worthy of note. Each of the roll support spindles 32, 34 includes a support shaft 78 and a sleeve 80 rotatably disposed about the support shaft for insertion into a toilet tissue roll. In the interest of simplicity, precise details of the roll support spindle are not shown in all drawing figures. Details of the roll support spindles are shown in FIGS. 2 and 4 only.

As stated earlier, the roll support spindles 32, 34 may be utilized with coreless rolls of toilet tissue which typically have a small central opening. Each support shaft 78 is tapered at the outer end thereof to facilitate entry of the roll support spindle into the central opening of the coreless toilet tissue roll.

The sleeve 80 includes flexible elements or fingers 82 which are depressed inwardly upon insertion of the sleeve into a coreless toilet tissue roll so that there is frictional engagement between the flexible elements of the sleeve and the support shaft to resist rotation of the sleeve and the toilet tissue roll about the support shaft to an extent that the roll will not "freewheel" relative to the roll support spindle.

FIG. 2 discloses roll end engagement members in the form of ribs 90 which project inwardly from the ends of the housing into the housing interior. Such ribs are observable only projecting from end 12 but it will be appreciated that like ribs project inwardly from housing end 14 as well. Ribs 90 are engageable by the ends of the toilet tissue rolls on the roll support spindles to prevent end-wise removal of the toilet tissue rolls from the roll support spindles while the second housing member 20 is in closed position.

Figure 7:
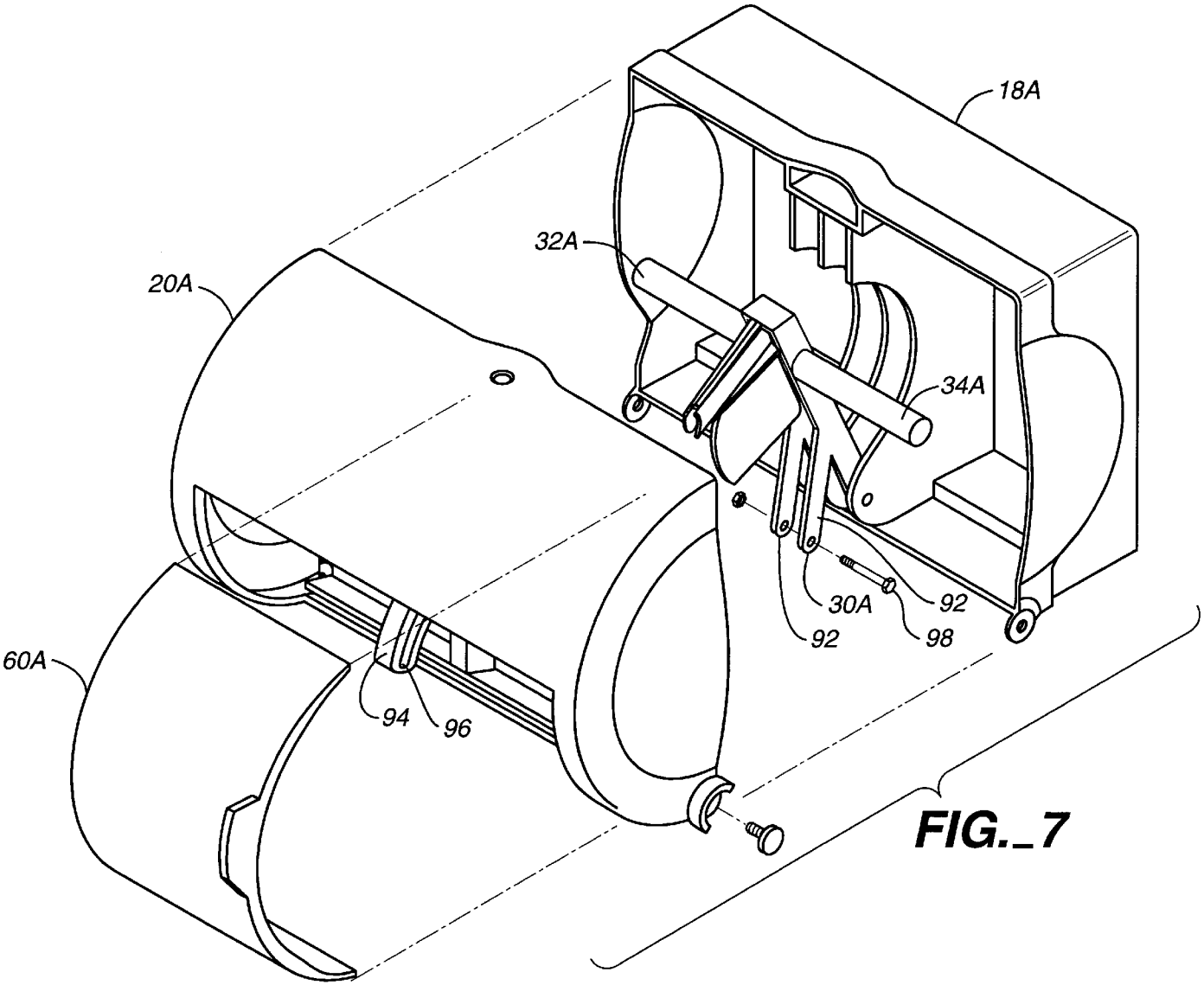
FIG. 7 is an exploded, perspective view of an alternate embodiment of the dispenser apparatus showing selected structural components thereof.
Figure 8:
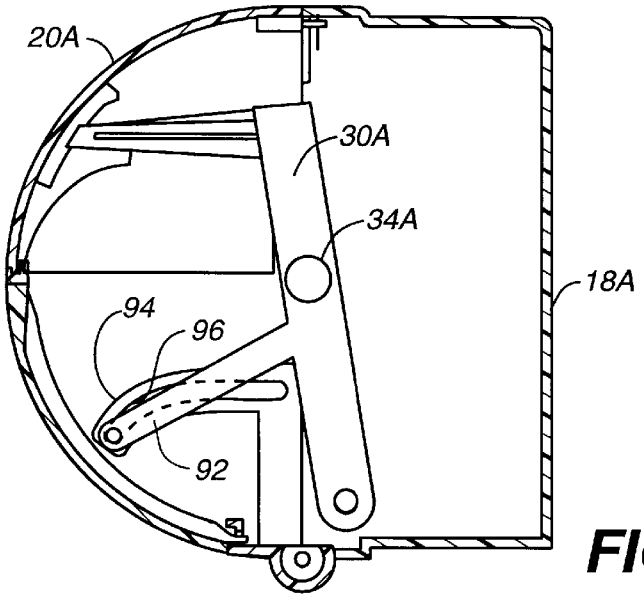
FIG. 8 is a cross-sectional, side view of the alternate embodiment of the apparatus and illustrating the first and second housing members thereof in closed condition.
Figure 9:
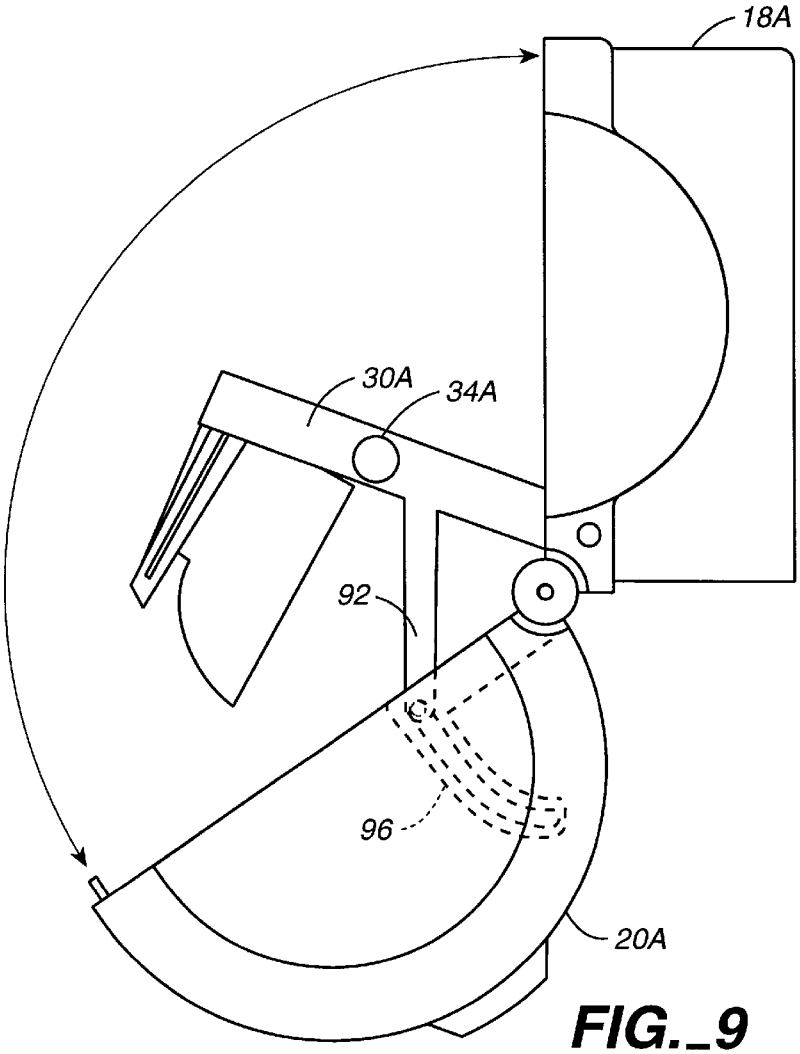
FIG. 9 is a side view of the embodiment of the invention shown in FIGS. 7 and 8 but illustrating the housing members pivoted open and the roll support structure placed in roll loading position.

FIGS. 7–9 illustrate an alternative embodiment of the apparatus including a first housing member 18A and a pivoted second housing member 20A accommodating a sliding door 60A. In this embodiment of the invention support frame 30A has a somewhat different configuration than above-described support frame 30. For example, support frame 30A includes two projecting members or legs 92. The illustrated roll support spindles 32A, 34A comprise opposed end segments of a unitary shaft affixed to support frame 30A.

Attached to second housing member 20A is an upwardly projecting connector element 94 defining a curved guide way or slot 96. Legs 92 are disposed on opposed sides of the connector element and a threaded connector 98 extends through holes at the ends of legs 92 and through curved slot 96. With this arrangement outward pivoting of the support frame 30A and roll support spindles 32A, 34A will automatically occur when the second housing member 20A is moved to its open position. FIG. 9 shows second housing member 20A pivoted to the open position and FIG. 8 illustrates the first housing member 18A and second housing member 20A latched in closed position. Closing of the second housing member will automatically cause support frame 30A to move to the position shown in FIG. 8.

We claim:

1. Apparatus for dispensing toilet tissue from rolls of toilet tissue, said apparatus comprising, in combination:

a double-ended housing defining a housing interior and including a first housing member and a second housing member connected to said first housing member and movable relative to said first housing member between an open position and a closed position;

roll support means including first and second roll support spindles for supporting first and second rolls of toilet tissue in a coaxial relationship with said first roll of toilet tissue located adjacent to one of the ends of said housing, the second roll of toilet tissue located adjacent to the other of the ends of said housing, and adjacent ends of said rolls of toilet tissue defining a space therebetween, said roll support means including a support frame pivotally connected to said first housing member, said roll support spindles protecting outwardly from said support frame in opposed directions, pivotal movement of said support frame relative to said first housing member causing said roll support spindles to move either toward or away from said first housing member, said support frame including a projection having a distal end defining a recess and said support frame defining an opening spaced from said recess;

stabilizer means for stabilizing said support frame when said second housing member is in closed position including a stabilizer member extending from said second housing member and positioned in the recess formed in the distal end of the projection of the support frame when the second housing member is in closed position to contribute to the structural stability of said projection and a stabilizer structural element extending from said first housing member into the opening in said support frame when the second housing member is in closed position;

a cover slidably positioned on said second housing member and selectively slidably movable relative to said housing between a first cover location in which said first roll of toilet tissue would be exposed for manual access and said second roll of toilet tissue would not be exposed for manual access and a second cover location wherein said second roll of toilet tissue would be exposed for manual access and said first roll of toilet tissue would not be exposed for manual access; and locking means for locking said cover against slidable movement relative to said second housing member between said first and second cover locations until substantial depletion of one of said rolls of toilet tissue, said locking means including a toilet tissue roll end engagement member pivotally mounted on said roll support means at a location between said first and second roll support spindles, dependent from said roll support means, and positioned in the space defined by adjacent ends of toilet tissue rolls supported by said roll support means and detents on said cover engageable with said toilet tissue roll end engagement member, said toilet tissue roll end engagement member depending from the projection of the support frame, freely pivotally mounted on said projection and continuously urged by the force of gravity into a substantially vertical orientation in the space defined by adjacent ends of toilet tissue rolls supported by said roll support means when said second housing member is in closed position, and a detent projecting from said cover urging said toilet tissue roll end engagement member to an inclined orientation when a force is exerted on said cover effecting sliding movement of said cover relative to said housing; and means for limiting pivotal movement of said support frame to limit the distance said roll support spindles may be moved away from said first housing member.

2. The apparatus according to claim 1 comprising two spaced detents on said cover alternately engageable with said toilet tissue roll end engagement member, one of said detents cooperable with said toilet tissue roll end engagement member to prevent sliding of said cover in the direction of one of the ends of said housing and the other of said detents cooperable with said toilet tissue roll end engagement member to prevent sliding of said cover in the direction of the other of the ends of said housing.

3. The apparatus according to claim 2 wherein each of said detents is generally triangular-shaped.

4. The apparatus according to claim 3 wherein each said detent includes a substantially straight abutment surface projecting substantially orthogonally relative to the path of sliding movement of said cover and an inclined ramp surface leading from said substantially straight abutment surface, both of said surfaces being engageable by said toilet tissue roll end engagement member during slidable movement of said cover relative to said housing.

5. The apparatus according to claim 1 wherein said second housing member defines an opening accommodating said cover, said apparatus additionally comprising reinforcement means for reinforcing said second housing member at said opening and resisting removal of said cover from said second housing member.

6. The apparatus according to claim 1 wherein said support frame is moveable in response to movement of said second housing member.

7. The apparatus according to claim 6 additionally comprising connector means connecting said support frame to said second housing member.

* * * * *